US008857306B1

(12) United States Patent
Edsall

(10) Patent No.: US 8,857,306 B1
(45) Date of Patent: Oct. 14, 2014

(54) FIREARM SUPPRESSOR

(71) Applicant: Richard A. Edsall, Ashton, MD (US)

(72) Inventor: Richard A. Edsall, Ashton, MD (US)

( * ) Notice: Subject to any disclaimer, the term of this patent is extended or adjusted under 35 U.S.C. 154(b) by 0 days.

(21) Appl. No.: 13/935,764

(22) Filed: Jul. 5, 2013

(51) Int. Cl.
*F41A 21/00* (2006.01)
*F41A 21/36* (2006.01)

(52) U.S. Cl.
CPC ..... *F41A 21/36* (2013.01)
USPC ..... 89/14.05; 89/14.4; 181/223

(58) Field of Classification Search
USPC ..... 89/14.05, 14.4; 181/223
See application file for complete search history.

(56) References Cited

U.S. PATENT DOCUMENTS

| | | | | |
|---|---|---|---|---|
| 1,111,202 | A | 9/1914 | Westfall | |
| 1,127,250 | A | 2/1915 | Humm | |
| 1,773,443 | A * | 8/1930 | Wilman | 89/14.4 |
| 2,442,773 | A | 6/1948 | Mason | |
| 2,448,382 | A | 8/1948 | Mason | |
| 3,385,164 | A | 5/1968 | Etal | |
| 3,713,362 | A | 1/1973 | Charron | |
| 4,176,487 | A | 12/1979 | Manis | |
| 4,530,417 | A | 7/1985 | Daniel | |
| 4,588,043 | A | 5/1986 | Finn | |
| 4,785,909 | A | 11/1988 | Young | |
| 5,029,512 | A | 7/1991 | Latka | |
| 5,164,535 | A | 11/1992 | Leasure | |
| 5,679,916 | A | 10/1997 | Weicher | |
| 6,109,387 | A | 8/2000 | Boretti | |
| 6,308,609 | B1 | 10/2001 | Davies | |
| 6,796,214 | B2 | 9/2004 | Hausken | |
| 7,588,122 | B2 * | 9/2009 | Brittingham | 181/223 |
| 8,162,100 | B2 * | 4/2012 | Shults et al. | 181/223 |
| 8,272,306 | B1 * | 9/2012 | Smith | 89/14.4 |
| 8,387,299 | B1 * | 3/2013 | Brittingham et al. | 42/90 |
| 8,424,441 | B2 * | 4/2013 | Brittingham et al. | 89/14.4 |
| 2004/0079221 | A1 | 4/2004 | Woods et al. | |
| 2007/0095198 | A1 * | 5/2007 | Dater et al. | 89/14.2 |
| 2009/0050403 | A1 * | 2/2009 | Brittingham | 181/223 |
| 2011/0036233 | A1 * | 2/2011 | DeGroat | 89/14.4 |
| 2011/0061966 | A1 * | 3/2011 | Brittingham | 181/223 |
| 2011/0067950 | A1 * | 3/2011 | Shults et al. | 181/223 |
| 2012/0199415 | A1 * | 8/2012 | Shults et al. | 181/223 |
| 2012/0279381 | A1 * | 11/2012 | Landolt | 89/14.4 |

* cited by examiner

*Primary Examiner* — Michelle R Clement
(74) *Attorney, Agent, or Firm* — Lieberman & Brandsdorfer, LLC

(57) ABSTRACT

Embodiments of the invention relate to an inertial damping apparatus in communication with a dynamic suppression mechanism for a firearm. The apparatus is in communication with both a muzzle of a projectile release device and with a suppressor. The apparatus dynamically extends between different states of compression. The apparatus is comprised of a body and an axial sleeve, with the sleeve functioning to guide movement of the body and to hold a first end of axially variable material in position when subject to compression.

18 Claims, 6 Drawing Sheets

900

800

1100

1000

FIREARM SUPPRESSOR

FIELD OF THE INVENTION

The present invention relates to an inertial damping apparatus in communication with a firearm apparatus. More specifically, the present invention isolates negative inertial effects of a suppressor in communication with the firearm apparatus.

BACKGROUND

Firearms function by discharging a projectile through an associated firearm housing. During use, a projectile travels through the housing at an accelerated speed and then discharges to a target or target vicinity. One byproduct of the projectile traveling through the housing is noise. It is known in the art to employ a suppressor, also known as a silencer, to reduce the noise associated with the projectile discharge. Various configurations have been employed to reduce noise.

SUMMARY OF THE INVENTION

The present invention relates to an apparatus and method for isolating negative inertial effects of a suppressor associated with discharge of a projectile.

In one aspect of the invention, an apparatus is provided with a body secured to a muzzle end of a projectile release device. The body defines a hollow interior that surrounds a projectile path. One end of the body is secured to a muzzle of end of the projectile release device, with a second end oppositely disposed. An axial sleeve is provided adjacent to the first end, the sleeve having two oppositely disposed sides. More specifically, the sleeve functions to guide movement of the body and to hold axially variable material in position when subject to compression. The axially variable material is provided on an external surface of the body, located between the sleeve and the second end. The material functions to dynamically extend between a first compressed state and a second compressed state in response to external pressure.

Other features and advantages of this invention will become apparent from the following detailed description of the presently preferred embodiments of the invention taken in conjunction with the accompanying drawings.

BRIEF DESCRIPTION OF THE DRAWINGS

The drawings referenced herein form a part of the specification. Features shown in the drawings are meant as illustrative of only some embodiments of the invention, and not of all embodiments of the invention unless otherwise explicitly indicated.

Figure 1:
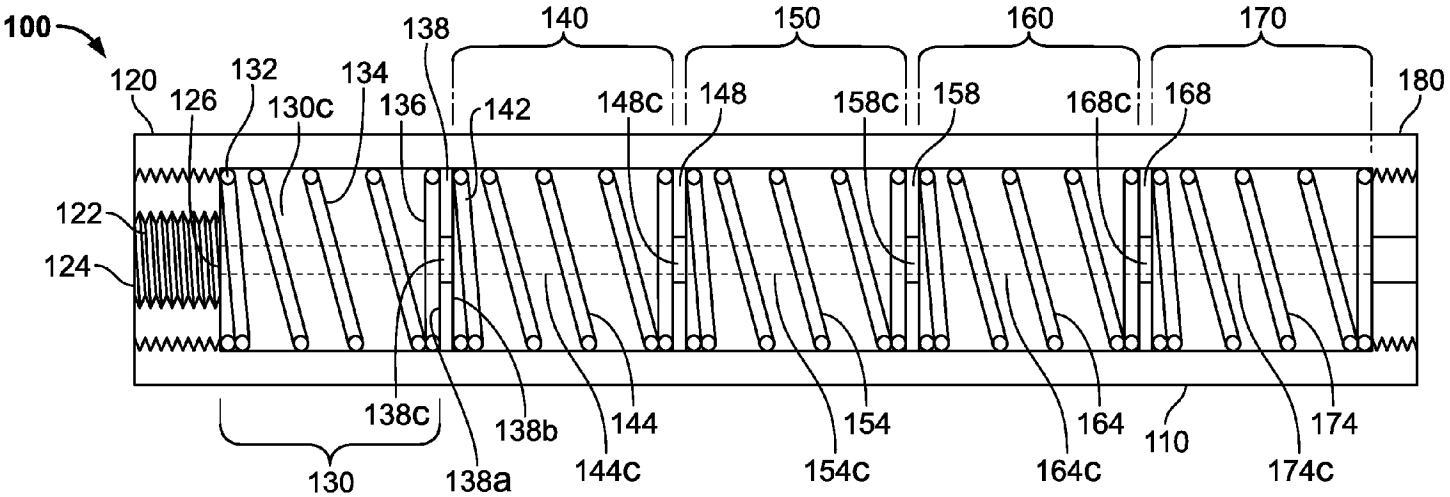
FIG. 1 is a sectional view of one embodiment of a noise suppressor for a firearm.

The drawings referenced herein form a part of the specification. Features shown in the drawings are meant as illustrative of only some embodiments of the invention, and not of all embodiments of the invention unless otherwise explicitly indicated. Implications to the contrary are otherwise not to be made.

DETAILED DESCRIPTION

As noted, suppression of noise from a firearm is not a new concept. Prior art configurations of noise suppressors employ fixed baffles which is a static approach to resolving the aspect of noise suppression. Accordingly, there is a need for a dynamic solution that functions to reduce energy of gases propelled from a projectile exiting an associated firearm muzzle.

It will be readily understood that the components of the present invention, as generally described and illustrated in the Figures herein, may be arranged and designed in a wide variety of different configurations. Thus, the following more detailed description of the embodiments of the apparatus, system, and method of the present invention, as presented in the Figures, is not intended to limit the scope of the invention, as claimed, but is merely representative of selected embodiments of the invention.

Reference throughout this specification to "a select embodiment," "one embodiment," or "an embodiment" means that a particular feature, structure, or characteristic described in connection with the embodiment is included in at least one embodiment of the present invention. Thus, appearances of the phrases "a select embodiment," "in one embodiment," or "in an embodiment" in various places throughout this specification are not necessarily all referring to the same embodiment.

Furthermore, the described features, structures, or characteristics may be combined in any suitable manner in one or more embodiments. In the following description, numerous specific details are provided, such as examples of noise supporting elements for a firearm and an associated projectile associated therewith to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

The illustrated embodiments of the invention will be best understood by reference to the drawings, wherein like parts are designated by like numerals throughout. The following description is intended only by way of example, and simply illustrates certain selected embodiments of devices, systems, and processes that are consistent with the invention as claimed herein.

A noise suppressor for a firearm utilizing concepts of the invention is illustrated in FIG. 1. More specifically, FIG. 1 is a sectional view of one embodiment of the noise suppressor (100). The suppressor includes an annular shaped body (110) having a first end (120) and a second end (180). The first end (120) includes a threaded interior wall (122) configured to be secured to threads of a barrel of a firearm (not shown). In one embodiment, the first end (120) may be alternatively configured and secured to the barrel of the firearm. The threaded interior wall (122) is one embodiment that may be employed for the securement. As shown, the threaded wall (122) has an annular aperture (124) that extends from the first end (120) to an interior second end (126). The size of the aperture is configured with a diameter that is greater than the diameter of a projectile exiting from the barrel of the firearm. Accordingly, the threaded interior wall is configured to secure to the barrel of the firearm and sized to receive a projectile exiting the barrel.

The threaded interior wall (122) is shown adjacent to the first end (120) of the annular shaped body (120). The second interior end (126) of the threaded wall is adjacently position to a first dynamic volume chamber (130). In the example shown herein, there are five dynamic volume chambers (130), (140), (150), (160), and (170). The first dynamic volume chamber (130) is adjacently mounted to the threaded wall (122), and the fifth dynamic volume chamber (170) is mounted adjacent to the second end (180). Although five dynamic volume chambers are shown, the invention should not be limited to this quantity. In one embodiment, the suppressor may be limited to two or more dynamic volume chambers. Accordingly, multiple dynamic volume chambers are provided within the body of the suppressor.

Each dynamic volume chambers is identical to an adjacently mounted dynamic volume chamber, and will be described herein with specificity with respect to the first dynamic volume chamber (130). As shown, the dynamic volume chamber (130) includes a hydraulic absorbing material (134) that extends the length of the chamber. In one embodiment, the absorbing material is any material configured to absorb shock and sound, i.e. compression and rarefaction of ambient gas. More specifically, each chamber (130) has a first end (132) and a second end (136). With respect to the first chamber (130), the first end (132) is adjacent to and in communication with the threaded wall (122) and the second end (136) defines the distal boundary of the chamber (132). A separator (138) is provided adjacent to the distal boundary of the first chamber (130). The separator (138) is in communication with the first end (132) of a first absorbing material (134) on a first side (138*a*) of the separator (138) and is in communication with a first end (142) of a second absorbing material (144) on a second side (138*b*) of the separator (138).

Each absorbing material and each adjacently mounted separator is configured and aligned with an aperture sized to receive a projectile. More specifically, the first absorbing material (134) of the first chamber (130) is configured with aperture (130*c*), and separator (138) is configured with aperture (138*c*). Both of these apertures (130*c*) and (138*c*) are at or near the same diameter and are aligned together and with the aperture of the threaded wall (122). Each of the sequential chambers (140)-(170) are configured with separate absorbing materials (144), (154), (164), and (174) respectively, with each absorbing material configured with an aperture (144*c*), (154*c*), (164*c*), and (174*c*), respectively. Accordingly, a projectile discharged from the firearm may travel an axial path formed by the aligned apertures through the body (110).

As shown in the example herein, there are five dynamic volume chambers, with the fifth chamber (170) being the furthest disposed from the firearm. The fifth chamber (170) includes an adjacently mounted exit (180). Upon completion of travel of the projectile through the fifth chamber, the projectile will exit the body (110) through the exit (180).

Each of the dynamic volume chambers (130)-(170) illustrated in FIG. 1 are shown in a rest state wherein the absorbing material is compressed. In one embodiment, the absorbing material may be in the form of a spring or an elastomer, or any material that is axially variable, i.e. changes shape along an axis, with the rest state including the absorbing material in a compressed state. As the projectile enters the first chamber (130), the absorbing material compresses and expands thereby causing movement of the first separator (138) in a lateral direction. In one embodiment, the body (110) is comprised of a non-expanding material; as such the expansion limits of each absorbing material are limited to the lateral direction. The projectile travels through the body one chamber at a time. As the projectile exits the first chamber (130), the absorbing material returns to a rest state, i.e. compressed form, and moves in the process, while the second chamber (140) receives the projectile with the second spring (132) compressing as the projectile travels through the second chamber. Each separator (138), (148), (158), and (168) is sized so that an exterior edge is in communication with an interior wall of the body (110). As such, as each separator (138)-(178) is subject to axial movement associated with compression of the absorbing material, debris that is in communication with the interior wall of the body (110) is removed from the wall.

As the projectile travels through the body (110) and each chamber therein (130)-(170), the projectile emits a byproduct. In one embodiment, the byproduct is a gas emitted by the projectile. Similarly, in another embodiment, the byproduct may include percussive energy, sound energy, and/or shock from the projectile. In both forms, the byproduct causes an expansion of the hydraulic absorbing material that extends the length of the associated chamber. Once the projectile exits the chamber, the material returns to an equilibrium state, i.e. compressed. Accordingly, the byproduct of the projectile causes the hydraulic absorbing material to change from a first compressed state to a second compressed state, and then to return to the first compressed state upon discharge of the projectile.

Figure 2:
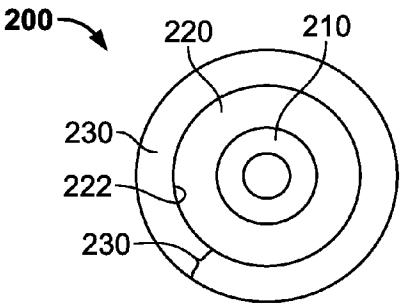
FIG. 2 is a front view of the suppressor shown in FIG. 1.

FIG. 2 is a front view (200) of the suppressor shown in FIG. 1. As shown, there are three concentric sections (210), (220), and (230). Starting from an interior portion of the suppressor, the first concentric section (210) represents the path of the projectile through the length of the suppressor. The path is formed by a combination of the chambers. More specifically, as shown in FIG. 1, each chamber is comprised of a separator and an absorbing material, with an aperture formed in both the separator and the absorbing material. Each separator is aligned with adjacently positioned absorbing material so that the apertures are aligned. Specifically, the separator of a chamber is aligned with the absorbing material in the chamber, as well as aligned with the absorbing material in an adjacently positioned chamber. This alignment and positioning of the separator with the absorbing material formed the path of the projectile as represented by the first concentric section (210).

As shown in FIG. 2, in addition to the first section (210), there are second and third sections (220) and (230), respectively. The second section (220) represents a width of an interior compartment of the suppressor. Each chamber and each separator have a width that extends the size of the width of the interior compartment. As described above in FIG. 1, as the chambers expand and contract, the separators are subject to movement with the adjacently positioned material. During this movement, the outside edge of each of the separators is in contact with an interior wall, as represented at (222), and this contact and movement effectively enables the separator to clean the residue created by the projectile and/or absorbing material from the interior wall (222). Accordingly, the second section (222) represents the width of the interior compartment of the suppressor.

The third concentric section (230) represents the exterior wall of the suppressor and its associated width. More specifically, the suppressor has an exterior wall that has a width that extends to the outermost side of the second section (220). The suppressor has a defined width to support housing the components or each compartment as well as functioning to mitigate noise by-product associated with travel of the projectile from the firearm and through the length of the suppressor.

In the embodiments shown in FIGS. 1 and 2, the suppressor is shown with five chambers, and each of the chambers including hydraulic absorbing material. The suppressor may include a minimum of one chamber, or expanded to include two or more additional chambers. The absorbing material may include a variety of material. In one embodiment, the absorbing material is in the form of a spring with each spring to extend the length of the chamber in which it is housed. In one embodiment, the material of the spring enables the spring or any material that absorbs compression and rarefaction of gas may withstand a temperature up to 550 degrees Fahrenheit. The separators, one per chamber, may be in the form of a washer, machined annular sleeve, ring of metal, etc., with each separator having an aperture sized to receive the projectile and a width sized to the width of the chamber so that the separator may remove debris that forms along the interior wall of the suppressor.

Figure 3:
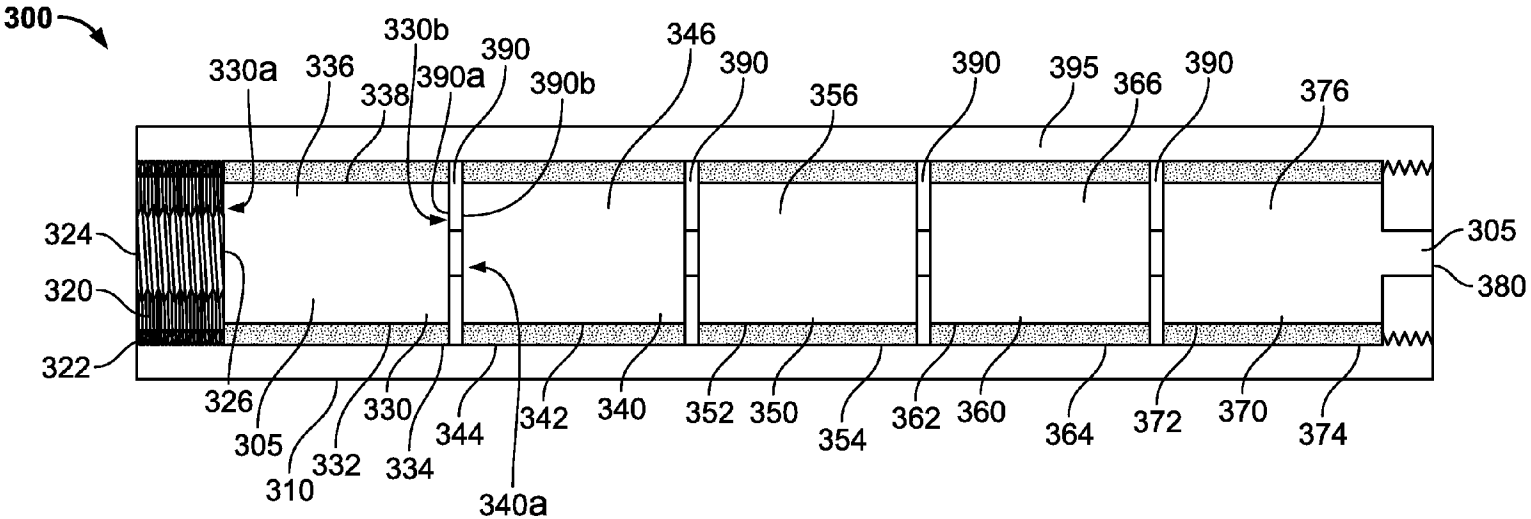
FIG. 3 is a sectional view of another embodiment of a noise suppressor for a firearm.

FIG. 3 is a sectional view of another embodiment of a noise suppressor (300) for a firearm. The suppressor includes an annular shaped body (310) having a first end (320) and a second end (380). An annular shaped aperture (305) is formed through the body (310) to accommodate noise suppression materials. In one embodiment, the body (310) is comprised of an aluminum material. The first end (320) includes a threaded interior wall (322) configured to be secured to threads of a barrel of a firearm (not shown). In one embodiment, the first end (320) may be alternatively configured and secured to the barrel of the firearm. The threaded interior wall (322) is one embodiment that may be employed for the securement. As shown, the threaded wall (322) has an annular aperture (324) that extends from the first end (320) to an interior second end (326). The size of the aperture is configured with a diameter that is greater than the diameter of a projectile exiting from the barrel of the firearm. Accordingly, the threaded interior wall is configured to secure to the barrel of the firearm and sized to receive a projectile exiting the barrel.

The threaded interior wall (322) is shown adjacent to the first end (320) of the annular shaped body (320). The second interior end (326) of the threaded wall is adjacently position to a first chamber (330) of a series of chambers. In the example shown herein, there are five chambers (330), (340), (350), (360), and (370). The first chamber (330) is adjacently mounted to the threaded wall (322), and the fifth chamber (370) is mounted adjacent to the second end (380). Although five chambers are shown, the invention should not be limited to this quantity. In one embodiment, the suppressor may be limited to two or more chambers. Each chamber has a sleeve, with each sleeve having an interior wall (332), (342), (352), (362) and (372) and an exterior wall (334), (344), (354), (364), and (374). Each of the interior walls is adjacent to an interior area of the chamber (336), (346), (356), (366), and (376); each of the exterior walls of the respective sleeves (334)-(374) are adjacently positioned to the annular shaped aperture (305) of the body (310). Accordingly, multiple chambers are positioned within the body of the suppressor.

Each chamber is identical to an adjacently mounted chamber, and will be described herein with specificity with respect to the first chamber (330). As shown, the chamber (330) includes an exterior wall sleeve (332) comprised of a material (338) to absorb compression and rarefaction of ambient gas, hereinafter referred to as an absorbing material, that extends the length of the chamber. In one embodiment, the absorbing material of the exterior wall may be in the form of a polyurethane, neoprene or silicon material. Each chamber (330) has a first end (330*a*) and a second end (330*b*). With respect to the first chamber (330), the first end (330*a*) is adjacent to and in communication with the threaded wall (322) and the second end (330*b*) defines the distal boundary of the chamber (332). A separator (390) is provided adjacent to the distal boundary of the first chamber (330). In one embodiment, the separator (390) is comprised of a stainless steel or aluminum material. The separator (390) is in communication with the second end (330*b*) of the first chamber (330) on a first side (390*a*) of the separator (390) and is in communication with a first end (340*a*) of the second chamber (340) on a second side (390*b*) of the separator (390). As shown, a separate (390) is provided between each set of adjacently position chambers.

Alignment of the multiple chambers (330)-(380), each comprised of a fluid responsive material encased within the annular shaped body (310), effectively forms a tube (395). The material may be in the form of polyurethane, neoprene, silicone rubber, or other fluid responsive material. In one embodiment, the material may withstand a temperature up to 500 degrees Fahrenheit. Each adjacently mounted chamber is separated by a separator. The configuration of the tube (395), including the material composition, provides flash suppression for a projectile traveling through the tube (395). The separators are each comprised of stainless steel, or an alternative material, that is resistive of high temperatures and flash associated with travel of the projectile. Each of the chambers (330)-(380), and more specifically, the respective separators, are adjacently mounted and aligned with an aperture sized to receive the projectile. Accordingly, a projectile discharged from the firearm may travel an axial path formed by the aligned apertures through the body (310).

As shown in the example herein, there are five chambers, with the fifth chamber (370) being the furthest disposed from the firearm. The fifth chamber (370) includes an adjacently mounted exit (380). Upon completion of travel of the projectile through the fifth chamber, the projectile will exit the body (310) through the exit (380). As the projectile travels through the chambers, the projectile emits a byproduct, such as gas, percussive energy, sound energy, flash, etc. The byproduct causes an expansion of the hydraulic absorbing material of the chamber walls, e.g. polyurethane, neoprene, or silicone rubber polymer. Once the projectile exits the chamber, the hydraulic absorbing material returns to an equilibrium state, i.e. compressed. Accordingly, the byproduct of the projectile causes the hydraulic absorbing material to change from a first compressed state to a second compressed state, and then to return to the first compressed state upon discharge of the projectile.

Each separator (390) is subject to axial movement along the length of its respective chamber. In one embodiment, the absorbing material that lines the chamber is in a compressed state at equilibrium and de-compresses when the projectile travels through the chamber. The axial movement of the separator (390) is associated with compression and de-compression of the absorbing material. Debris does not accumulate on the interior walls of the chamber. In one embodiment, the characteristics of the material do not enable debris to adhere to the surface. The debris associated with any projectile byproduct exits the chamber through the same aperture as the projectile. As such, there is no need for a cleaning of the interior walls of the chamber(s).

Figure 4:
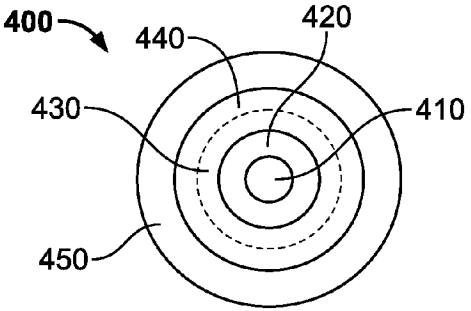
FIG. 4 is an end view of the noise suppressor shown in FIG. 3.

FIG. 4 is an end view (400) of the noise suppressor shown in FIG. 3. As shown, there are five concentric sections (410), (420), (430), (440), and (450). Starting from an interior portion of the suppressor, the first concentric section (410) represents the path of the projectile through the openings in each of the separators. The path is formed by a combination of the chambers and their associated separators. Each adjacent chamber is aligned by the annular shaped aperture (305) such that the separators and their associated apertures are aligned. The second concentric section (420) represents the diameter of the threaded opening that secures the suppressor body to the firearm. The third concentric section (430) represents an interior wall of each of the chambers, with the fourth concentric section (440) representing an end view of the silicon elastomer section. The fifth concentric section (450) represents an exterior wall of the suppressor body (310). Accordingly, as shown herein, each of the components of the suppressor have an annular representation and are aligned to form a path for travel of a projectile exiting the firearm, with the materials of the components functioning to suppress both noise and flash associated with the projectile travel.

Figure 5:
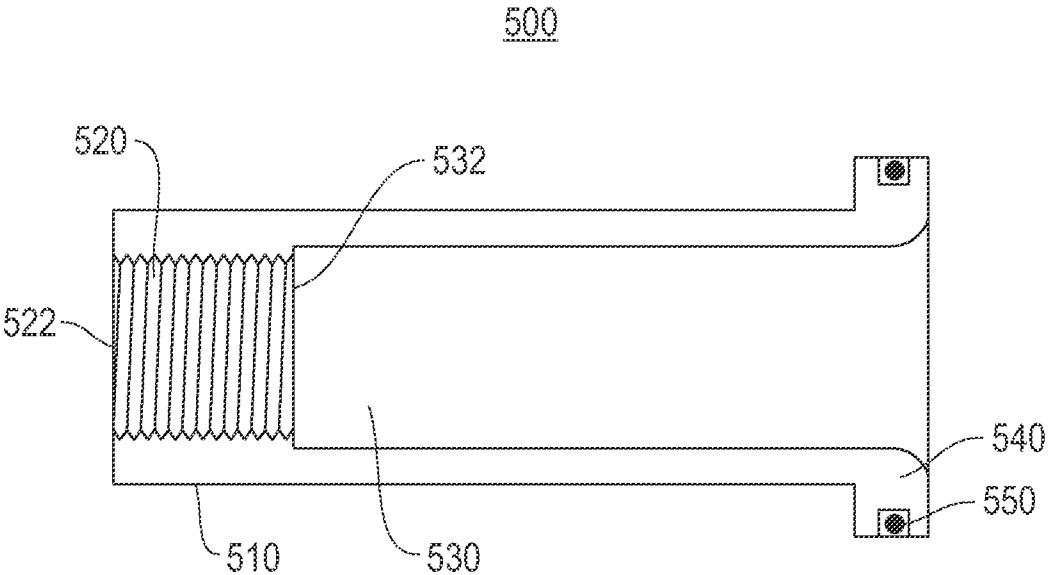
FIG. 5 is a sectional view of an inertial damping mechanism.

When applied to a semi-automatic, a silencer may cause an undesired inertial effect due to the inherent weight of the silencer. FIG. 5 is a sectional view of an inertial damping mechanism (500), which in one embodiment is configured to be attached to the silencer of FIG. 3. The inertial damping mechanism (500) includes a body (510) provided to isolate the negative inertial effect of the silencer. The body (510) is a piston with two sections, including a first section (520) and second section (530). The first section (520) is shown here with threading as an attachment element, and in one embodiment is employed to secured the body (510) to a projectile release device (not shown), such as a firearm. While the projectile release device is regarded as a firearm hereafter, it should be noted that the attachable projectile release device as described should not be limited as such. In one embodiment, the threaded surface of the first section (520) is configured to be threaded to a barrel of a firearm (not shown) having a corresponding threaded surface. The second section (530) is shown with a hollowed out interior. Accordingly, the body (510) is configured to be secured to the firearm at one end through an attachable apparatus.

The first section (520), includes a proximal end (522) and a distal end (524), and the second section (530) includes a proximal end (532), a distal end (534), and an exterior wall (536). As shown, for the first section (520), the proximal end (522) is configured to be in communication with a barrel of a firearm or an alternative projectile release device, and the distal end (524) is in communication with a proximal end (532) of the second section (530). The distal end (534) of the second section (530) includes a toric joint (540). The toric joint (540) functions to restrict gas within the suppressor from entering the inertial damping mechanism (500). Specifically, the toric joint (540) is molded to receive a toric ring (550) e.g. an o-ring. The toric ring (550) acts as a seal to force gas to exit distal of the inertial damping mechanism (500).

Figure 6:
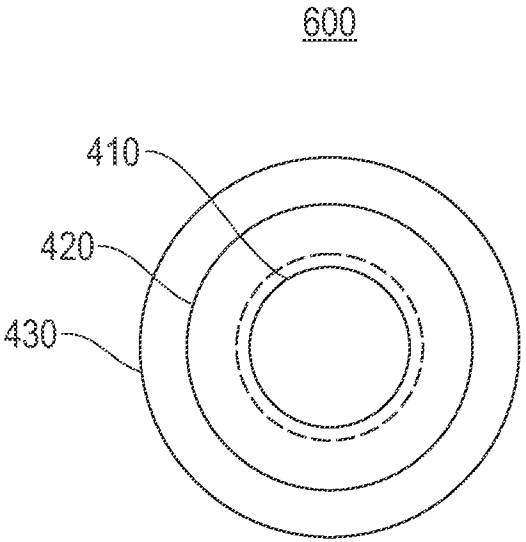
FIG. 6 is an end view of the inertial damping mechanism.

FIG. 6 is an end view (600) of the inertial damping mechanism shown in FIG. 5. As shown, there are three concentric sections (610), (620), and (630). Starting from an interior portion of the inertial damping mechanism, the first concentric section (610) represents the annular shape of the first section (520). The second concentric section (620) represents the diameter of the inertial damping mechanism (500), and specifically, the diameter of the second section (530) with respect to the exterior wall (536). The third concentric section (630) represents the diameter of annular shape of the inertial damping mechanism (500) with respect to the position of the toric join (540). Accordingly, as shown herein, each of the components of the inertial damping mechanism have an annular representation and are aligned to form a path for travel of a projectile exiting the firearm, with the materials of the components functioning to mitigate any undesired inertial effect due to the inherent weight of a silence in communication with the firearm.

Figure 7:
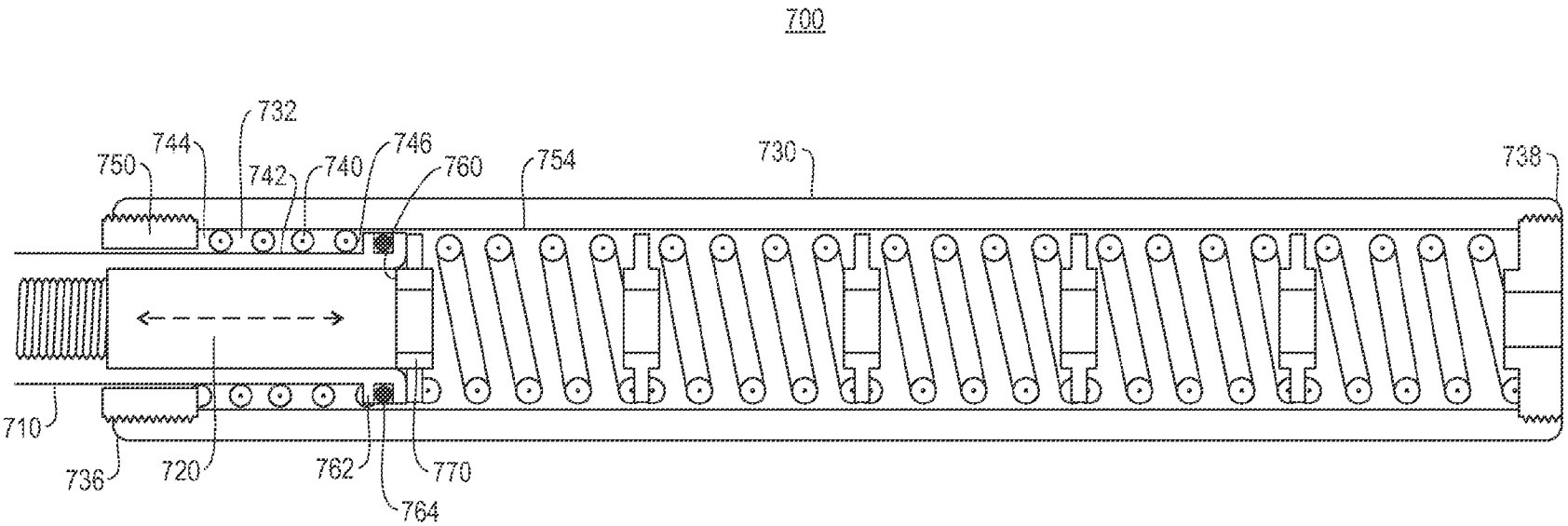
FIG. 7 is a sectional view of a damping apparatus secured to a suppressor.

The inertial damping mechanism is configured to secure to a firearm and to a suppressor, also referred to herein as a silencer. FIG. 7 is a sectional view (700) of the inertial damping mechanism (500) attached to a suppressor (730). When attached to a barrel of the firearm, the body (710) mimics a movement of the barrel, specifically in an axial direction. In one embodiment, the barrel of the firearm moves between an extended state and a contracted state and a change of state of the barrel is followed by a corresponding change of state of position of the body (710). The body (710) is partially inserted into the hollow of the suppressor (732) in a first position. A proportion of the body inserted within the suppressor (730) directly corresponds to a state of the firearm. Specifically, a change of state of the barrel of the firearm from an extended state to a contracted state results in a change of state of a position of the body (710) from a first position having a greater proportion of the body (710) inserted into the suppressor (730) to a second position having a lesser proportion of the body (710) inserted into the suppressor (730). Similarly, a change of state of the barrel from a contracted state to an extended state results in a change of state of the position of the body (710) from a second position having a lesser proportion of the body inserted into the suppressor (730) to a first position having a greater proportion of the body inserted into the suppressor (730). Accordingly, the movement and state of the body attached to the barrel directly corresponds with the movement and state of the barrel.

Axially variable material (740) is in communication with an external surface (742) of the body (710), and functions to absorb inertia generated by the barrel movement. In one embodiment, the axially variable material (740) is confined to a hollow of the suppressor (732) and is specifically confined to a first end (744) by a gland sleeve (750) and a second end (746) by a second side of the body (760). In one embodiment, the axially variable material is a spring (740), and compression of the spring, absorbs the generated inertia. The position of the body (710) has a direct relationship with a compression state of the spring (740). Specifically, the body (710) restricts the spring (740) to a first compressed state when in the first position, and enables the spring (740) to be in a second compressed state when in the second position. The first and second states pertain to different levels of compression. In the first state the spring is compressed in a naturally loaded state, and in the second state the spring is in a greater state of compression in comparison with the first state. In one embodiment, the second state takes place in response to expanding gases associated with movement of the projectile through the body. Transitively, the spring (740) is in the second compressed state when the barrel is in the extended state and is in the first compressed state when the barrel is in the contracted state. In one embodiment, the spring (740) returns to the first compressed state responsive to a projectile leaving the firearm. Accordingly, a change of state of the axially variable material (740) responsive to a change of state of the barrel causes the axially variable material (740) to absorb inertia generated by the change of state of the barrel.

As mentioned above, the axially variable material (740) is confined to the first end (744) by the gland sleeve (750) and is confined to the second end (746) by the second side of the body (760). The gland sleeve (750) is fixed to an interior wall of the hollow of the suppressor (732) and in addition to retaining the position of one end of the axially variable material (740), guides the body on the axial path (720) when the body (710) changes state. The second side of the body (760)

restricts the position of the axially variable material (740) through an extended end (762), also referred to herein as the toric joint, that extends to an interior wall of the suppressor (754). The toric joint (762) provides additional functionality in that it restricts gas within the suppressor from entering the inertial damping mechanism (500). Specifically, the toric joint (762) is molded to receive a toric ring (764) e.g. an o-ring, and is adjacent to the second side of the body (760). The toric ring (764) acts as a seal to force gas to exit through a second side of the suppressor (738), and preventing gas from exiting through the hollow of the suppressor (732). Accordingly, a gland sleeve is provided to guide the body and restrict the position of the axially variable material about a first end and an extended end acts as a gas seal and restricts the position of the axially variable material about a second end.

The toric ring (764) is received by the toric joint (762), which is fixed to the second end (760) of the body (710). The toric joint (762) functions as a seal between the external surface (742) of the body (710) and the interior wall (754) of the suppressor (730), also referred to herein as a silencer. As referenced above, the toric joint (762) functions to restrict gas emission associated with travel along the projectile path toward a first end (736) of the suppressor (730), distal from the body (710). An annular partition (770) is provided adjacent to the second side (760) of the body (710). The partition (770) is sized to receive the toric joint (762). Accordingly, the toric joint (762) functions to enable the functionality of the sleeve in conjunction with the suppressor.

Figure 9:
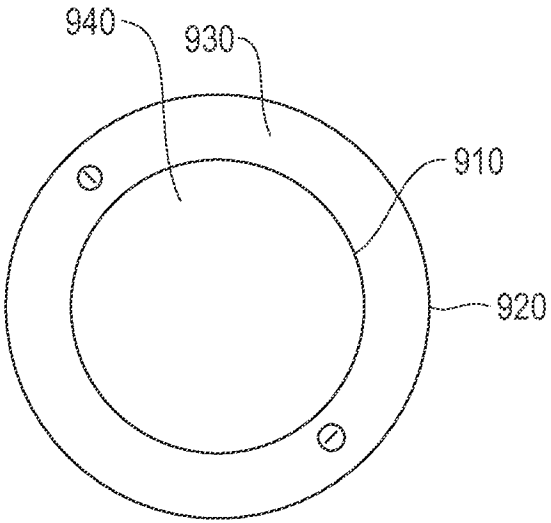
FIG. 9 is an end view of the sleeve shown in FIG. 8.
Figure 8:
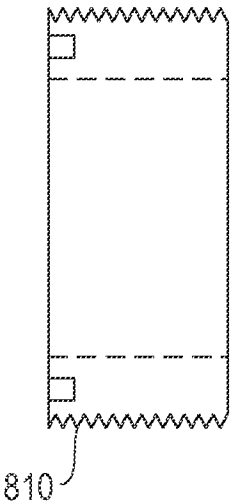
FIG. 8 is a sectional view of the gland sleeve.

FIG. 8 is a sectional view of the gland sleeve (800), hereinafter referred to as the sleeve, which in one embodiment is configured to limit movement of the axially variable material (740) with respect to the barrel of the firearm and the suppressor. As shown, the sleeve (800) has an annular shape with an exterior threaded surface (810) to secure the sleeve to the suppressor, and a concentric interior section (820) representing the path of the projectile. In one embodiment, the suppressor has a corresponding threaded interior wall that secured to the threaded surface (810), thereby securing the attachment of the sleeve (800) to the suppressor. FIG. 9 is an end view (900) of the sleeve shown in FIG. 8. As shown, there are two concentric sections (910) and (920). Starting from an interior portion of the sleeve, the first concentric section (910) represents the annular shape of the projectile path, and the second section (920) represents the width of the sleeve (900). In one embodiment, the sleeve is in the shape a ring with a threaded exterior surface, and the distance (930) between the first and second sections (910) and (920) represents the width of the ring having a hollow interior (940).

Figure 11:
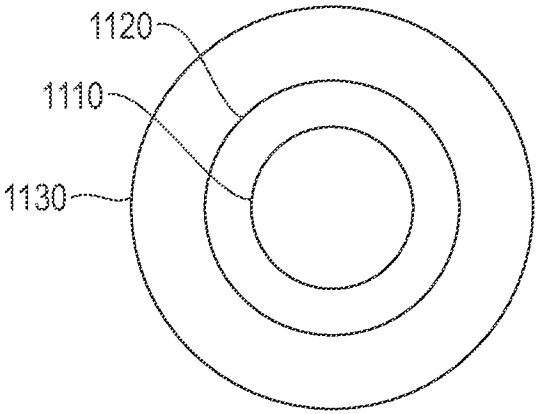
FIG. 11 is an end view of the partition shown in FIG. 10.
Figure 10:
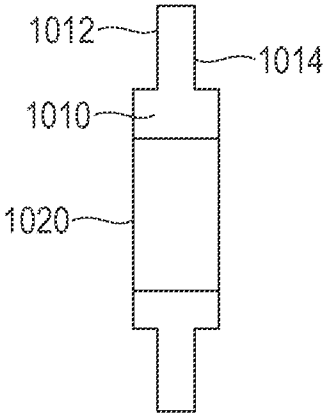
FIG. 10 is a sectional view of the annular partition.

As shown, an annular partition (770) is provided in communication with the inertial damping mechanism (500) and the inertial material of the suppressor. FIG. 10 is a sectional view of the annular partition (1000), hereinafter referred to as the partition. As shown, the partition (1000) has an annular shape with two sections (1010) and (1020). The second section (1020) is an interior section sized to receive the projectile (not shown), and in one embodiment is concentric with the path projectile path provided in both the inertial damping mechanism and the suppressor. The first section (1010) extended from the second section (1020). In one embodiment, the second section (1020) is hollow, and the first section (1010) is comprised of a material. The first section (1010) is received by the toric joint one side (1012) and by axially variable material of the suppressor on a second side (1014). FIG. 11 is an end view (1100) of the partition shown in FIG. 10. As shown, there are three concentric sections (1110), (1120), and (1130). Starting from an interior portion of the partition, the first concentric section (1110) represents the diameter of the projectile path, the second section (1120) represents the distance between the edge of the projectile path and the edge of the first section configured to receive the toric joint, and the third section (1130) represents the annular width of the toric joint.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope. Accordingly, the scope of protection of this invention is limited only by the claims and their equivalents.

I claim:

1. An apparatus comprising:

a body defining a hollow interior surrounding a projectile path, the body having a first end and a second end, the first end adaptively secured to a muzzle end of a projectile release device, and the second end oppositely disposed;

an axial sleeve adjacent to the first end of the body in an initial state, the sleeve having a first side and an oppositely disposed second side, the first side in communication with an external surface of the body, the sleeve to guide movement of the body and to hold a first end of axially variable material in position upon compression;

a toric joint fixed to the second end of the body, wherein the joint is a seal between the external surface of the body and an interior wall of a suppressor; and the axially variable material disposed about the external surface of the body between the sleeve and the second end, the material to dynamically extend between a first compressed state and a second-compressed state, wherein compression of the material is responsive to external pressure exerted upon the body.

2. The apparatus of claim 1, wherein the first state is a naturally loaded compressed state.

3. The apparatus of claim 1, wherein the second state is a greater state of compression in comparison to the first state.

4. The apparatus of claim 1, further comprising the second side of the sleeve in communication with the suppressor.

5. The apparatus of claim 4, further comprising the suppressor defining a hollow interior surrounding the path.

6. The apparatus of claim 4, further comprising the second side of the sleeve having a threaded surface to adaptively secure to a corresponding threaded surface of the suppressor.

7. The apparatus of claim 1, further comprising the toric joint to restrict gas emission associated with travel along the projectile path toward a first end of the suppressor, distal from the body.

8. The apparatus of claim 1, further comprising an annular partition adjacent to the second end of the body, the partition sized to receive the toric joint.

9. The apparatus of claim 1, further comprising the first end of the housing having a threaded wall adapted to be threadedly received by the muzzle end.

10. The apparatus of claim 1, wherein the axially variable material is a spring.

11. An apparatus comprising:

a primary body having a first end and a second end, the first and second ends defining a hollow interior, the first end with an attachable mechanism to be secured to a secondary body and the second end oppositely disposed thereof, and a toric joint in communication with the second end of the primary body;

an inertial damping mechanism in communication with the primary body about a portion of an external perimeter of the primary body, the inertial damping mechanism to extend between a first compressed state and a second compressed state responsive to inertia generated by axial movement of the secondary body, the extension between the first compressed state and the second compressed state to counteract the generated inertia; and a sleeve in communication with the inertial damping mechanism, the sleeve to hold the inertial damping mechanism in position.

12. The apparatus of claim 11, further comprising the inertial damping mechanism to return to the compressed state following release of a projectile from the primary body.

13. The apparatus of claim 11, further comprising a suppressor in communication with the second end of the primary body.

14. The apparatus of claim 13, wherein the sleeve is fixed to an interior wall of the suppressor.

15. The apparatus of claim 11, wherein the toric joint seals an external surface of the body to an interior wall of a suppressor in communication with the second end of the primary body.

16. The apparatus of claim 15, further comprising the joint to restrict gas emission associated with travel of a projectile toward a first end of the suppressor, distal from the primary body.

17. The apparatus of claim 11, wherein the inertial damping mechanism is a spring.

18. The apparatus of claim 8, further comprising the partition in communication with a second axially variable material within an interior of the suppressor.

* * * * *